United States Patent [19]

Groiss

[11] 4,101,268

[45] Jul. 18, 1978

[54] ROTARY KILN WITH PLANETARY COOLER

[75] Inventor: Karl Groiss, Linkoping, Sweden

[73] Assignee: F. L. Smidth & Co., Cresskill, N.J.

[21] Appl. No.: 742,235

[22] Filed: Nov. 16, 1976

[30] Foreign Application Priority Data

Nov. 17, 1975 [GB] United Kingdom ..... 47244/75

[51] Int. Cl.[2] ..... F27B 7/02; F27B 7/38

[52] U.S. Cl. ..... 432/80; 432/106

[58] Field of Search ..... 432/80, 77, 103, 105, 432/106, 117, 78, 245; 16/168; 106/100; 74/250; 34/13, 20, 62; 165/88, 82; 308/2 R, 36, 237 R

[56] References Cited

U.S. PATENT DOCUMENTS

| | | | |
|---|---|---|---|
| 3,073,584 | 1/1963 | Troeger | 308/2 R |
| 3,840,335 | 10/1974 | Deussner | 432/80 |
| 3,859,039 | 1/1975 | Heinemann et al. | 432/80 |
| 3,975,147 | 8/1976 | Vering et al. | 432/80 |

*Primary Examiner*—John J. Camby
*Assistant Examiner*—Henry C. Yuen
*Attorney, Agent, or Firm*—Pennie & Edmonds

[57] ABSTRACT

A rotary kiln plant is disclosed having a rotary kiln and a cooler system having a plurality of cooler tubes mounted in planetary fashion about the rotary kiln. Each cooler tube has an inlet end portion which communicates with the rotary kiln for reception of the material to be cooled and a rearward end portion having an outlet end for exiting the cooled material. First support means is positioned adjacent the inlet end portion of the cooler tube and second support means is positioned adjacent the outlet end portion of the cooler tube so as to retain the axis of the cooler tube substantially parallel to the axis of rotation of the kiln. The second support means includes an annular member disposed about the cooler tube, with first mounting means including at least two generally parallel flange members secured to the annular member, each flange member defining a bore which extends generally perpendicular to the axis of the tube, and second mounting means including two generally parallel flange members secured to peripheral portions of the rotary kiln for rotation therewith, with means positioned between the cooler tube and the rotary kiln for pivotally connecting the mounting means so as to provide pivotal movement between the material outlet end portion of the cooler tube and the rotary kiln.

28 Claims, 7 Drawing Figures

ROTARY KILN WITH PLANETARY COOLER

BACKGROUND OF THE INVENTION

1. Field of the Invention

The invention relates to means to support a cooler tube of a planetary cooler in planetary fashion about a rotary kiln.

2. Description of the Prior Art

Rotary kilns, such as are used for example in the cement industry for the burning of cement clinker have, normally at the clinker outlet end, a cooler for cooling the clinker before further treatment. A well known cooler type is the planetary cooler, consisting of a number of cooler tubes mounted in a ring around the outlet end of the kiln and extending substantially parallel to the longitudinal axis of the kiln. In such an arrangement, the tubes have the same general inclination as the kiln.

At the inlet end of a cooler tube, the kiln and the tube are usually in fixed connection with one another; however, the tube, at its outlet end, is usually supported by a bracket or similar means attached to the outer kiln shell to provide a bearing with a limited axial movement in relation to the tube. This movement is necessary because of the cooler tubes, which are more rigid and which operate at a lower temperature than the kiln, move slightly in the axial direction in relation to the kiln during operation due to sagging which occurs in the kiln which produces a slight axial shortening of the kiln. This sagging is most noticeable at the hot end of the kiln which corresponds to the outlet end of the cooler tube. In the bearing of such a cooler tube support, there is a great amount of friction during operation of the kiln since the bearing bracket attached to the outer kiln shell follows the movement of the kiln, whereas the cooler tube remains rigid.

Efforts have been made to avoid or reduce the disadvantageous effects of these frictional forces upon the cooler tube by supporting the tube by special sliding surfaces or rollers provided between the tube and the bearing. Such an arrangement requires feeding of a lubricant to the sliding surfaces. As yet, no acceptable means for lubricating these surfaces has been developed.

A member connecting two adjacent cooler tubes and the kiln is likewise known. In this arrangement, the support member is rigidly connected to the cooler tubes by bolts and hinged on the kiln shell, but due to the sagging of the kiln, the rigid connection at the cooler tubes is subjected to destructive forces during operation.

Annular rims affixed to the periphery of the rotary kiln casing in order to support all the satellite cooling tubes are also known in the art. For example, West German Pat. No. 24,24,224.8 to Polysius AG relates to a rotary kiln for the heat-treatment of material and having a number of satellite cooling tubes distributed uniformly round the rotary kiln periphery at the exit end of the kiln, the inlet ends of these tubes being connected by short inlet pipes to the interior of the rotary kiln, and each tube being supported on the rotary kiln casing by two support bearings, whereof the rearmost support bearing, as seen in the material feed direction, holds the corresponding cooling tube so that this tube can move axially.

I have invented a new means to support a cooler tube in planetary fashion about a rotary kiln. The new movable support allows for independent cooler and kiln sagging due to heat expansion and gravity, in such a way that the difficulties so far encountered in connection with reducing the friction and bending forces arising between a cooler tube and its support are overcome. It also facilitates the hitherto rather complex mounting of cooler tubes on the kiln proper, which is becoming increasingly more difficult with the increased size of kilns and cooler tubes.

SUMMARY OF THE INVENTION

The invention relates to a rotary kiln plant having a rotary kiln and a planetary cooler system mounted for rotation therewith. The cooler system including at least one cooler tube having a forward portion and a rearward portion. The forward portion includes an inlet end portion communicating with the rotary kiln for reception of material to be cooled and the rearward portion includes an outlet end portion for exiting the cooled material. The invention further relates to means to support each cooler tube in planetary fashion about the rotary kiln including first support means positioned adjacent the inlet end portion of the cooler tube and second support means positioned adjacent the outlet end portion of the cooler so as to retain the longitudinal axis of the cooler tube substantially parallel to the axis of rotation of the rotary kiln. At least the second support means comprises an annular member disposed about the cooler tube, first mounting means having at least two generally parallel flanges mounted on the annular member, each flange defining a bore extending generally perpendicular to the axis of the cooler tube, second mounting means having two generally parallel flanges secured to peripheral portions of the rotary kiln for rotation therewith, and means positioned between the cooler tube and the rotary kiln for pivotally connecting the mounting means so as to provide pivotal movement between the cooler tube and the rotary kiln in axial and radial directions.

In one embodiment, the cooler tube is surrounded by a reinforcing ring member having a pair of outwardly extending, parallel flanges interconnected by a transverse tubular part. Each parallel flange has a bore extending therethrough configured to pivotally receive the tubular member. The inside surface of the ring member serves as a sliding surface in which friction has been minimized by providing a convex curvature relative to the cooler tube.

The bracket of the kiln includes a pair of outwardly extending, parallel flanges cooperating with those of the cooler bracket in such a way that the mounted pivots are initially wholly received in the bores of the latter bracket as a consequence of the limited space available between the cooler tubes. The pivots are subsequently extended axially and fixed into adjacent bores in the kiln bracket.

This embodiment permits axial and radial displacement between the cooler tubes and the kiln during operation, thus eliminating undesirable stress concentrations therein. Sagging of the kiln between two live rings causes contraction of the upper part and expansion of the lower part of the kiln shell between two spaced supports of a cooler tube.

Due to the ability of the movable support to pivot about its pivots and to allow the cooler tube to roll upon the convex inner surface of the support, substantially all frictional and bending forces between the cooler tube and the kiln shell are eliminated.

In a second embodiment, the movable support comprises an annular member axially fixed and disposed about the cooler tube. The annular member is provided with a double-flanged bracket containing pivot bearings for a first pair of coaxial pivots of a connecting member. A second pair of coaxial pivots are journalled in the mounting bracket on the kiln. The connecting member comprises a first, substantially cylindrical, hollow body and a second body slidably engaged therein, the opposite ends of the bodies being each provided with two parallel pivots.

Preferably, the ends of at least one of the pivot pairs are journalled in spherical bearings in the appertaining mounting bracket.

In this double-pivoted arrangement, the cooler tube axis is constantly kept parallel to the axis of rotation of the kiln and no sliding or tilting inside the ring member surrounding the cooler tube occurs during expansion and contraction of the tube and the kiln.

When mounting the connecting member in the adjacent bearings, the first and second body of the connecting member are initially pushed together to register with the bearings and subsequently moved away from one another into engagement with the bearings. Finally, the two bodies are prevented from axial displacement by means of a spacer which may be in the form of two cylinder sections of an inner diameter approximately equal to the inner diameter of the first body, and mounted between the said body and a shoulder provided on the second body. The spacer may be fixed to the second body by mechanical means.

In order to overcome the complex stresses exerted on the cooler suspension and arising from the temperature-based independent cooler and kiln sagging during kiln operation, it is advantageous that the first and second body are able to tilt in common relative to the mounting bracket by means of the spherical bearings. Moreover, they are able to rotate relative to one another in their telescopically engaged position in order to adjust themselves to the independent axial displacements of the two bearing points of a mounting bracket.

The second or double-pivoted construction may be made more economical by attaching two ring plates to the outer surface of the cooler tube. The ring plates which may be welded serve as a substitute for the separate ring member since the ring is not restricted from tilting movement.

In addition to the material savings thus obtained, a further advantage is that the ring plates can be welded without any special regard for accuracy because the double pivoting suspension evens out all minor differences between the desired and the actual position.

BRIEF DESCRIPTION OF THE DRAWINGS

Preferred embodiments of the invention are described hereinbelow with reference to the drawings wherein.

DETAILED DESCRIPTION OF THE PREFERRED EMBODIMENTS

Figure 1:
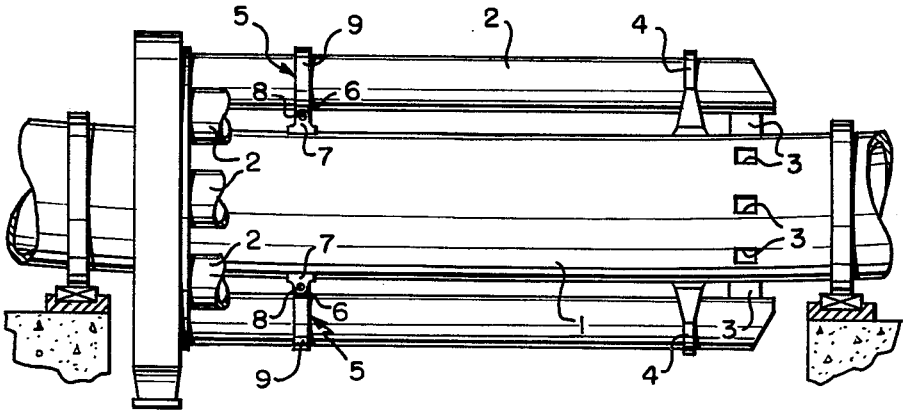
FIG. 1 is a side view, partially in section, of a rotary kiln provided with cooler tubes (two of which are shown) of a planetary cooler, the tubes being secured to the kiln by means of movable supports in accordance with the invention.

FIG. 1 is an axial view, partially in section, of a rotary kiln 1, provided with cooler tubes 2 (two of which are shown) of a planetary cooler. At the inlet end 3, each cooler tube 2 is secured to the kiln 1 by means of a conventional non-movable support 4, comprising a bracket supporting the tube 2 and a yoke surrounding a portion of the tube, and connected to the bracket by mechanical means such as bolts.

Near its outlet end, the cooler tube 2 is supported by a movable support 5 comprising a mounting bracket 6 on the cooler tube 2 (see FIGS. 2 and 3) and a mounting bracket 7 on the kiln shell 1 and connecting means 8 pivotally fitted to both brackets 6 and 7. Non-movable support 4 may alternately be substituted by a movable support of the types illustrated in detail in FIGS. 4, 5, and 6.

Figure 2:
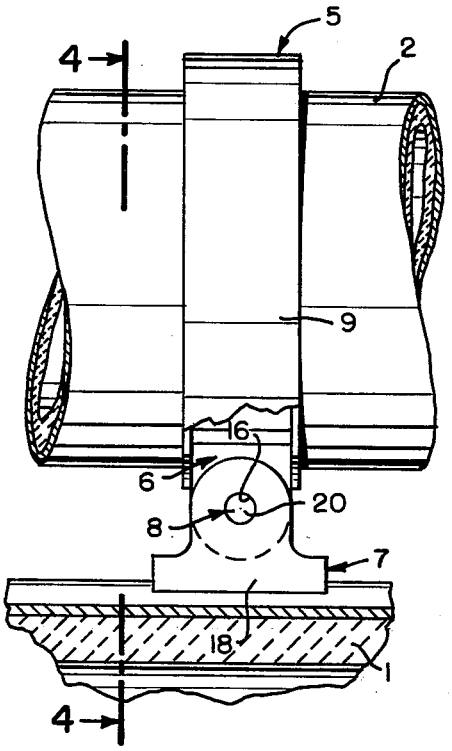
FIG. 2 is a side view, partially in section, of a movable support according to the invention.
Figure 4:
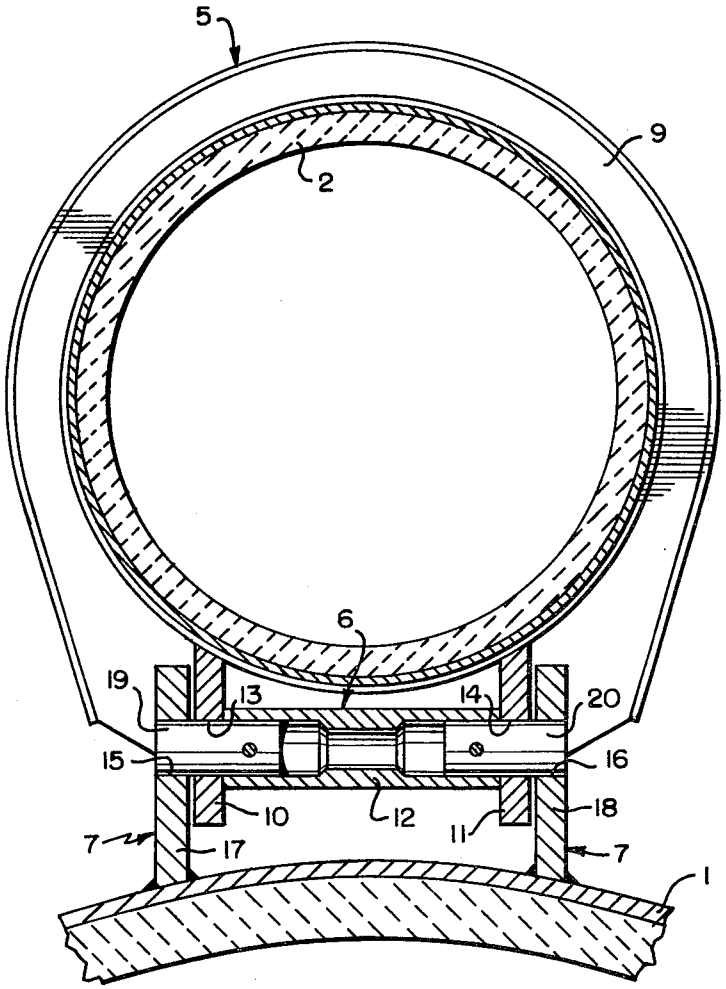
FIG. 4 is a section taken along line 4—4 of FIG. 2.

In a preferred embodiment, as illustrated in FIGS. 2 and 4, the cooler mounting bracket 6 is secured to an annular member 9 which surrounds the cooler tube 2. The bracket 6 consists of two parallel flanges 10 and 11 having bores 13 and 14 and a tubular body 12 integral with and connecting the flanges 10 and 11.

The mounting bracket 7 also consists of two parallel flanges 17 and 18 having bores 15 and 16. The bracket 7 is secured to the kiln shell. This may be accomplished in a variety of ways including, for example, welding.

Bearing pivots 19 and 20 form the connecting means between the two brackets. They are held in the bracket 6 within the bores 13 and 14 during mounting of cooler tube 2. After bores 13 and 14 of bracket 6 are aligned with bores 15 and 16 of bracket 7, the pivots 19 and 20 are extended axially into engagement also with bores 15 and 16. The pivots 19 and 20 are then fixed in this position by known means, thereby forming a pivotal axis connection between the two brackets.

The ring member 9 may have a slightly convex inner surface in relation to the cooler tube so as to permit a small twisting of the ring relative to the tube.

This twisting occurs due to the different rolling and sagging movements of the cooler tubes in relation to the kiln shell when the plant is in operation.

The maximum twisting force will act on the mounting bracket 7 when the cooler tube is in its outermost lateral positions, i.e. in its "3 o'clock" or "9 o'clock" position, because in these positions the gravitational force on the cooler tube is tangential to the restraining effect of the brackets. The modification shown in FIGS. 3 and 5 is especially adapted for counteracting these twisting forces.

To avoid the effect of twisting exerted on the brackets 6 and 7, especially when the cooler tube is in one of its outermost lateral positions, the pivots 23*a* and 23*b* are journalled in spherical bearings 25*a* and 25*b* fixed in the bracket flanges 10 and 11 of the cooler tube.

Figure 3:
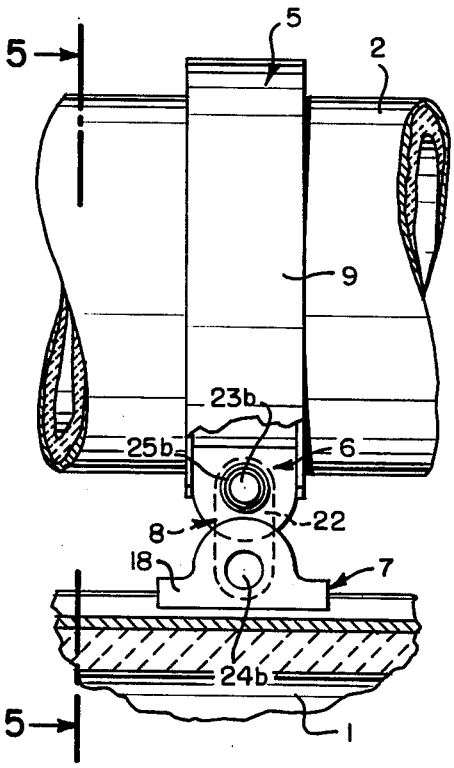
FIG. 3 is a side view, partially in section, of a modification of the movable support shown in FIG. 2.
Figure 5:
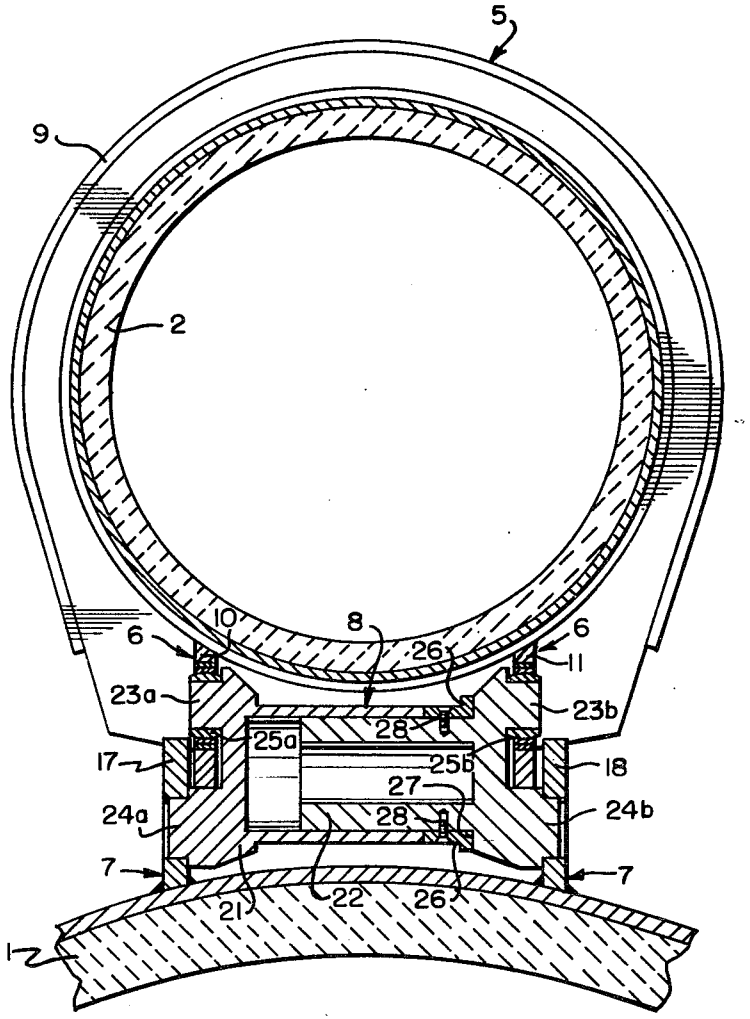
FIG. 5 is a section taken along line 5—5 of FIG. 3.

In the modification, illustrated in FIGS. 3 and 5, the connecting means 8 comprises a first, substantially cylindrical, hollow body 21, and a second body 22, slidably and rotatably engaged therein. Each of the ends of the cylindrical bodies 21 and 22 are provided with two parallel pivots 23*a*, 24*a*, and 23*b*, 24*b*. The coaxial pivots 23*a*, 23*b* and 24*a*, 24*b* are pivotally engaged in the appertaining mounting bracket flange pairs 10, 11 and 17, 18.

As a consequence, the thermally conditioned displacement of the cooler tube, in relation to the kiln, will take place substantially parallel to the initial expansion of the kiln. Accordingly, the ring-shaped member 9, surrounding the cooler tube 2, will not twist and therefore, its inner surface need not be convexly shaped.

Figure 7:
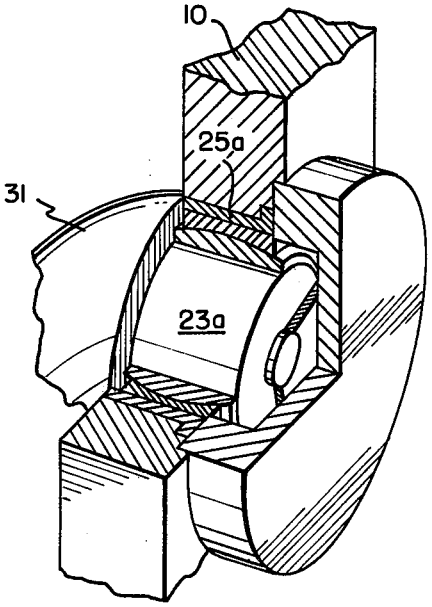
FIG. 7 is an enlarged view of a coaxial pivot shown in FIG. 6.

Similarly, the second pair of pivots 24*a* and 24*b* could also be journalled in spherical bearings similar to bearings 25*a* and 25*b*, respectively, as shown in detail for those bearings in FIG. 7 (not shown).

When mounting a cooler tube 2, the two cylindrical bodies 21 and 22, constituting the connecting means, are initially pushed together and spacer member 26 is then inserted between each pair of bracket flanges 10, 11 and 17, 18. The cylindrical bodies 21 and 22 are then slidably separated into the bearing of the flanges. Finally, the spacer members in the form of cylinder sections 26, having inner diameters aproximating that of the first body 21, are mounted between the cylindrical body 21 and a shoulder 27 on cylindrical body 22.

The spacer members 26 are attached to the cylindrical body 22 by known means such as screws 28.

Figure 6:
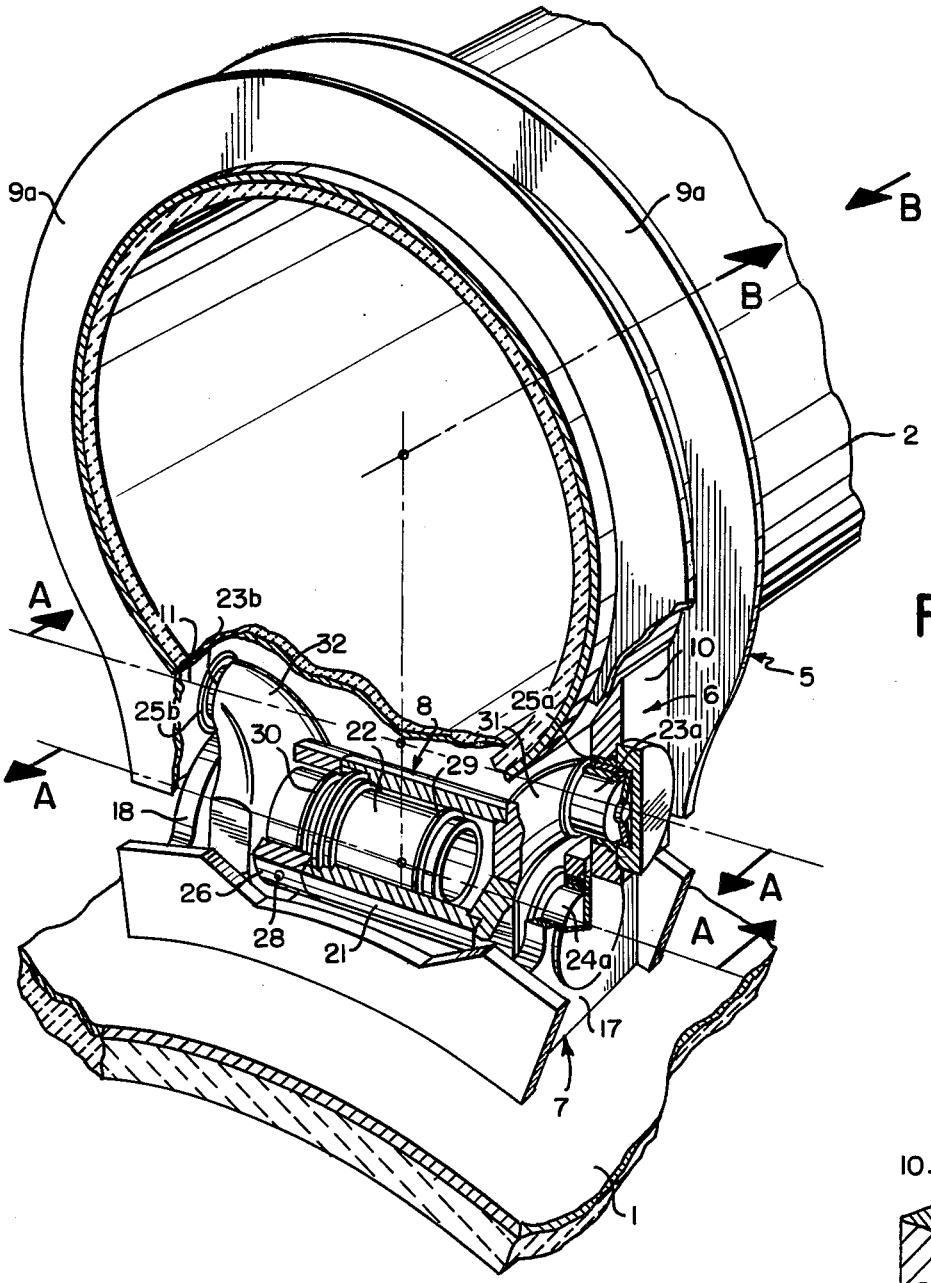
FIG. 6 is a partially broken away perspective view of a modification of the movable support shown in FIG. 5.

The construction, illustrated in FIG. 6, is a modification of that shown in FIG. 5 and seen in the opposite axial direction along the kiln. In this modification, the bracket flanges 17 and 18, attached to the kiln 1, are less widely spaced than the bracket flanges 10 and 11 attached to the cooler tube. Also, the ring member 9 is replaced by two ring plates 9*a* which support the bracket 6.

In order to facilitate relative rotation of the cylindrical bodies 21 and 22 about their common axes, the engaging end of the hollow body 21 is provided with a slip ring 29. Immediately prior to insertion of the spacer member 26, a further slip ring 30 is fitted to the second body 22.

The pivots 23*a* and 23*b* are mounted on spurs 31 and 32, attached to the bodies 21 and 22, respectively. The pivots 24*a* and 24*b* are all mounted in spherical bearings. The pivot 23*a* and bearing 25*a* of these spherical bearings are illustrated in FIG. 7.

Relative axial movement between the cooler tube and the kiln is represented by the arrows B in FIG. 6. This movement is counteracted by simultaneous symmetrical rotation at the pivot journals. Twisting of the cooler tube relative to the kiln, upon sagging of the cooler tube in the 3 o'clock or 9 o'clock position is represented by the arrows A in FIG. 6. The concentrated stress that such movement would create is dissipated by simultaneous relative rotation between the bodies 21 and 22, and by tilting of the pivots in the spherical journals in opposite senses on opposite sides of the cooler tube.

I claim:

1. A rotary kiln having a planetary cooler system mounted for rotation therewith, said cooler system including at least one cooler tube having a forward portion and a rearward portion, said forward portion including an inlet end portion communicating with the rotary kiln for reception of material to be cooled, said rearward portion including an outlet end portion for exiting the cooled material, means to support each cooler tube in planetary fashion about said rotary kiln including first support means positioned adjacent said inlet end portion of said cooler tube and second support means positioned adjacent said outlet end portion of said cooler tube so as to retain the longitudinal axis of the cooler tube substantially parallel to the axis of rotation of the rotary kiln, at least said second support means comprising:

(a) an annular member disposed about said cooler tube;

(b) first mounting means having at least a first pair of generally parallel flanges mounted to said annular member, each flange defining at least one bore extending generally transverse to the axis of said cooler tube and disposed generally between said cooler tube and the rotary kiln;

(c) second mounting means having at least a second pair of generally parallel flanges secured to peripheral portions of the rotary kiln for rotation therewith, each flange of said second pair being disposed adjacent to an associated flange of said first pair of flanges and defining at least one bore spaced from the bores defined by said first pair of flanges;

(d) means positioned between said cooler tube and said rotary kiln pivotally connecting said first and second mounting means for rotation of the cooler tube about the axes of the bores defined by said first and second pairs of flanges, said pivot means including:

i. a first generally elongated member connected to at least one pair of adjacent associated flanges by means of pivot members journaled in a bore of each flange, said first elongated member having a generally cylindrical section extending generally transverse to the longitudinal axis of said cooler tube; and ii. a second generally elongated member connected to at least one other pair of adjacent associated flanges by means of pivot members journaled in a bore of each flange, said second generally elongated member having a generally cylindrical section extending generally transverse to the longitudinal axis of said cooler tube and positioned for relative rotation within said generally cylindrical section of said first elongated member so as to permit relative axial movement between said cooler tube and said rotary kiln while permitting rotational movement of at least portions of said cooler tube about an axis extending generally radially of said rotary kiln.

2. The rotary kiln according to claim 1 wherein said first mounting means further comprises a spherical bearing in each of at least one pair of said generally parallel flanges so as to permit said cooler tube relative movement in relation to the longitudinal axis of said rotary kiln, at least about an axis generally parallel and adjacent to the longitudinal axis of said two generally elongated engaged members.

3. The rotary kiln according to claim 2 wherein said second generally elongated member of said pivotal connecting means comprises a generally cylindrical shoulder portion positioned adjacent said generally cylindrical section of said first generally elongated member.

4. The rotary kiln according to claim 3 wherein said pivotal connecting means further comprises at least one annular spacer member to be mounted between said first substantially cylindrical body and said shoulder portion of said second substantially cylindrical body.

5. The rotary kiln according to claim 4 wherein the inner diameter of said spacer member approximates the diameter of the bore that extends through said first generally elongated member.

6. The rotary kiln according to claim 4 wherein said spacer members are secured to said second generally elongated member by mechanical means.

7. The rotary kiln according to claim 2 wherein said parallel flanges of said second mounting means are spaced apart a distance greater than are a pair of parallel flanges of said first mounting means.

8. The rotary kiln according to claim 2 wherein each of said flanges of both the first and second mounting means comprise a spherical bearing.

9. The rotary kiln according to claim 1 wherein said two generally parallel flanges of said second mounting means are welded to peripheral portions of said rotary kiln.

10. The rotary kiln according to claim 1 wherein said first support means comprises:

(a) a bracket secured to peripheral portions of the rotary kiln;

(b) a yoke disposed about said cooler tube attached to said bracket; and (c) mechanical means to secure said yoke to said bracket.

11. The rotary kiln according to claim 1 wherein said first support means comprises:

(a) an annular member disposed about said cooler tube;

(b) first mounting means having at least two generally parallel flanges mounted to said annular member, each flange defining a bore extending generally perpendicular to the axis of said cooler tube;

(c) second mounting means having two generally parallel flanges secured to peripheral portions of the rotary kiln for rotation therewith; and (d) means positioned between said cooler tube and said rotary kiln for pivotally connecting said mounting means so as to provide pivotal movement between said cooler tube and said rotary kiln in axial and radial directions.

12. The rotary kiln according to claim 1 wherein inner surface portions of said annular member define a generally convex surface in relation to said cooler tube to permit movement of the annular member in a direction parallel to the longitudinal axis of said cooler tube.

13. A rotary kiln having a planetary cooler system mounted for rotation therewith, said cooler system including at least one cooler tube having a forward portion and a rearward portion, said forward portion including an inlet end portion communicating with the rotary kiln for reception of material to be cooled, said rearward portion including an outlet end portion for exiting the cooled material, means to support each cooler tube in planetary fashion about said rotary kiln including first support means positioned adjacent said inlet end portion of said cooler tube and second support means positioned adjacent said outlet end portion of said cooler tube so as to retain the longitudinal axis of the cooler tube substantially parallel to the axis of rotation of the rotary kiln, at least said second support means comprising:

(a) an annular member which comprises two ring plates positioned about said cooler tube;

(b) first mounting means having at least a first pair of generally parallel flanges mounted to said annular member, each flange defining at least one bore extending generally transverse to the axis of said cooler tube and disposed generally between said cooler tube and the rotary kiln;

(c) second mounting means having at least a second pair of generally parallel flanges secured to peripheral portions of the rotary kiln for rotation therewith, each flange of said second pair being disposed adjacent to an associated flange of said first pair of flanges and defining at least one bore extending in generally parallel spaced relation relative to the bore of said associated flange;

(d) means positioned between said cooler tube and said rotary kiln pivotally connecting said first and second mounting means for rotation of the cooler tube about the axes of the bores defined by said first and second pairs of flanges, said pivot means including:

i. a first generally elongated member connected to at least one pair of adjacent associated flanges by means of pivot members journaled in a bore of each flange, said first elongated member having a generally cylindrical section extending generally transverse to the longitudinal axis of said cooler tube; and ii. a second generally elongated member connected to at least one other pair of adjacent associated flanges by means of pivotal members journaled in a bore of each flange, said second generally elongated member having a generally cylindrical section extending generally transverse to the longitudinal axis of said cooler tube and positioned for relative rotation within said generally cylindrical section of said first elongated member so as to permit relative axial movement between said cooler tube and said rotary kiln while permitting rotational movement of at least portions of said cooler tube about an axis extending generally radial of said rotary kiln.

14. The rotary kiln according to claim 13 wherein said first mounting means further comprises a spherical bearing in each of at least one pair of said generally parallel flanges so as to permit said cooler tube relative movement in relation to the longitudinal axis of said rotary kiln, at least about an axis generally parallel and adjacent to the longitudinal axis of said two generally elongated engaged members.

15. The rotary kiln according to claim 14 wherein said parallel flanges of said second mounting means are spaced apart a distance greater than are a pair of parallel flanges of said first mounting means.

16. The rotary kiln according to claim 15 wherein said first generally elongated member further comprises at least a first slip ring positioned within the bore extending therethrough to facilitate rotation of said second elongated member when said second member is slidably engaged in said first member.

17. The rotary kiln according to claim 16 wherein said second generally elongated member of said pivotal connecting means comprises a generally cylindrical shoulder portion positioned adjacent said generally cylindrical section of said first generally elongated member.

18. The rotary kiln according to claim 17 wherein said pivotal connecting means further comprises at least one annular spacer member to be mounted between said first substantially cylindrical body and said shoulder portion of said second substantially cylindrical body.

19. The rotary kiln according to claim 18 wherein the inner diameter of said spacer member approximates the diameter of the bore that extends through said first generally elongated member.

20. The rotary kiln according to claim 19 wherein said spacer members are secured to said second generally elongated member by mechanical means.

21. The rotary kiln according to claim 20 wherein a second slip ring is fitted to said second generally elongated member.

22. The rotary kiln according to claim 21 wherein said pivotal connecting means further comprises a first spur connecting one of said generally cylindrical pivotal members of said first elongated member to one of said parallel flanges of said first mounting means and a second spur connecting one of said generally cylindrical pivotal members of said second elongated member to a second flange of said first mounting means parallel to said first flange.

23. The rotary kiln according to claim 22 wherein each of said flanges of both the first and second mounting means comprises a spherical bearing.

24. A rotary kiln according to claim 23 wherein said two generally parallel flanges of said second mounting means are welded to peripheral portions of said rotary kiln.

25. The rotary kiln according to claim 13 wherein said first support means comprises:

(a) a bracket secured to peripheral portions of the rotary kiln;

(b) a yoke disposed about said cooler tube attached to said bracket; and (c) mechanical means to secure said yoke to said bracket.

26. The rotary kiln according to claim 13 wherein said first support means comprises:

(a) an annular member disposed about said cooler tube;

(b) first mounting means having at least two generally parallel flanges mounted to said annular member, each flange defining a bore extending generally perpendicular to the axis of said cooler tube;

(c) second mounting means having two generally parallel flanges secured to peripheral portions of the rotary kiln for rotation therewith; and (d) means positioned between said cooler tube and said rotary kiln for pivotally connecting said mounting means so as to provide pivotal movement between said cooler tube and said rotary kiln in axial and radial directions.

27. A rotary kiln having a planetary cooler system mounted for rotation therewith, said cooler system including at least one cooler tube having a forward portion and a rearward portion, said forward portion including an inlet end portion communicating with the rotary kiln for reception of material to be cooled, said rearward portion including an outlet end portion for exiting the cooled material, means to support each cooler tube in planetary fashion about said rotary kiln including first support means positioned adjacent said inlet end portion of said cooler tube and second support means positioned adjacent said outlet end portion of said cooler tube so as to retain the longitudinal axis of the cooler tube substantially parallel to the axis of rotation of the rotary kiln, at least said second support means comprising:

(a) an annular member disposed about said cooler tube;

(b) first mounting means having at least a first pair of generally parallel flanges mounted to said annular member, each flange defining at least one bore extending generally transverse to the axis of said cooler tube and disposed generally between said cooler tube and the rotary kiln;

(c) second mounting means having at least a second pair of generally parallel flanges secured to peripheral portions of the rotary kiln for rotation therewith, each flange of said second pair of flanges disposed adjacent to an associated flange of said first pair of flanges and defining at least one bore spaced from the bores defined by said first pair of flanges and extending generally parallel thereto;

(d) means positioned between said cooler tube and said rotary kiln pivotally connecting said first and second mounting means for rotation of the cooler tube about the axes of the bores defined by said first and said second pair of flanges, said pivot means including:

i. a first generally elongated member connected to at least one pair of adjacent flanges by means of pivot members journaled in a bore of each flange, said first elongated member having a generally cylindrical section extending generally transverse to the longitudinal axis of said cooler tube; and ii. a second generally elongated member connected to at least one other pair of adjacent associated flanges by means of pivot members journaled in a bore of each flange, said second generally elongated member having a generally cylindrical section extending generally transverse to the longitudinal axis of said cooler tube and positioned for relative rotation within said generally cylindrical section of said first elongated member so as to permit relative axial movement between said cooler tube and the rotary kiln while permitting universal rotational movement of at least portions of said cooler tube about an axis extending generally radially of the rotary kiln.

28. A rotary kiln having a planetary cooler system mounted for rotation therewith, said cooler system including at least one cooler tube having a forward portion and a rearward portion, said forward portion including an inlet end portion communicating with the rotary kiln for reception of material to be cooled, said rearward portion including an outlet end portion for exiting the cooled material, means to support each cooler tube in planetary fashion about said rotary kiln including first support means postioned adjacent said inlet end portion of said cooler tube and second support means postioned adjacent said outlet end portion of said cooler tube so as to retain the longitudinal axis of the cooler tube substantially parallel to the axis of rotation of the rotary kiln, at least said second support means comprising:

(a) an annular member disposed about said cooler tube;

(b) first mounting means having at least two generally parallel flanges mounted to said annular member, each flange defining a bore extending generally perpendicular to the axis of said cooler tube, said first mounting means having a spherical bearing positioned within a bore of each flange of at least one pair of said generally parallel flanges so as to permit movement of said cooler tube relative to the longitudinal axis of said rotary kiln;

(c) second mounting means having two generally parallel flanges secured to peripheral portions of the rotary kiln for rotation therewith;

(d) means positioned between said cooler tube and said rotary kiln for pivotally connecting said mounting means so as to provide pivotal movement between said cooler tube and said rotary kiln in axial and radial directions, said pivotal connecting means comprising:

i. a first generally elongated member connected to at least a first pair of adjacent flanges including one flange secured to said annular member and one flange secured to peripheral portions of said kiln, said first member defining a bore therethrough and having a generally cylindrical section extending generally transverse to the longitudinal axis of said cooler tube, said first elongated member having one end portion having two generally cylindrical pivot members journaled in adjacent flanges; and ii. a second generally elongated member connected to at least a second pair of adjacent flanges, said second member having a generally cylindrical section extending generally transverse to the longitudinal axis of said cooler tube and slidably engaged within said first elongated member, said second elongated member having an end portion having two generally cylindrical members journaled one in each of said other adjacent pair of flanges thereby facilitating axial movement of said cooler tube relative to said rotary kiln, while permitting universal rotational movement of at least portions of said cooler tube about an axis extending generally radially of the rotary kiln.

* * * * *